US008295716B2

(12) United States Patent
Jeon

(10) Patent No.: US 8,295,716 B2
(45) Date of Patent: Oct. 23, 2012

(54) SHEET PROCESSING DEVICE HAVING USER SAFETY UNIT AND IMAGE FORMING APPARATUS HAVING THE SAME

(75) Inventor: Suk Kyu Jeon, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 339 days.

(21) Appl. No.: 12/641,981

(22) Filed: Dec. 18, 2009

(65) Prior Publication Data

US 2010/0158567 A1 Jun. 24, 2010

(30) Foreign Application Priority Data

Dec. 24, 2008 (KR) ..... 10-2008-0132993

(51) Int. Cl.
*G03G 15/00* (2006.01)

(52) U.S. Cl. ..... 399/9; 399/108; 399/110

(58) Field of Classification Search ..... 399/9, 21–23, 399/108, 110, 407–410; 271/265, 296–298, 271/305

See application file for complete search history.

(56) References Cited

U.S. PATENT DOCUMENTS 5,342,034 A * 8/1994 Mandel et al. ..... 270/58.08
2004/0218955 A1 * 11/2004 Coombs et al. ..... 399/407

FOREIGN PATENT DOCUMENTS

JP 11-180629 7/1999
JP 2006-328892 12/2006

* cited by examiner

*Primary Examiner* — Hoan Tran
(74) *Attorney, Agent, or Firm* — Stanzione & Kim, LLP

(57) ABSTRACT

A sheet processing device including a safety unit to prevent accidental operation of the sheet processing device. The sheet processing device can include a body to receive a processing unit to process a sheet of paper and a door provided at the body to be opened from or closed to the body. The sheet processing device can further include a sensing unit to sense the presence of the sheet of paper fed into the body, and a safety unit linked with the door, the safety unit being adapted to restrict the sensing unit or release the restricted sensing unit to control operation of the sheet processing device.

18 Claims, 5 Drawing Sheets

SHEET PROCESSING DEVICE HAVING USER SAFETY UNIT AND IMAGE FORMING APPARATUS HAVING THE SAME

CROSS-REFERENCE TO RELATED APPLICATIONS

This application claims the benefit of Korean Patent Application No. 2008-0132993, filed on Dec. 24, 2008 in the Korean Intellectual Property Office, the disclosure of which is incorporated herein by reference in its entirety.

BACKGROUND

1. Field of the Invention

Embodiments of the present general inventive concept relate to a sheet processing device having an improved safety unit to prevent a user accident.

2. Description of the Related Art

Image forming apparatuses are devised to print an image on a printing medium. Examples of image forming apparatuses include printers, copiers, facsimiles, and so-called multifunctional apparatuses that combine some of the functionalities of the aforementioned.

A sheet processing device is provided in a variety of electronic appliances including an image forming apparatus, etc. The sheet processing device performs, e.g., a punching process to punch a hole in a sheet of paper fed thereto, or a stapling process to staple a bundle of sheets of paper.

A sheet of paper discharged from the image forming apparatus is subjected to post treatment while passing through the sheet processing device. The sheet of paper discharged from the image forming apparatus may pass through the sheet processing device in an automatic manner, or in a manual manner.

The sheet processing device may be operated to remove impurities accumulated therein, or to replace consumable elements. Such a removal or replacement operation is performed by a user (or worker) in an open state of the sheet processing device. However, if malfunction of, e.g., a sensor occurs during the operation, implementation of the punching process or stapling process may be impossible and user safety may not be assured.

SUMMARY

Example embodiments of the present general inventive concept provide a sheet processing device and a safety unit thereof which can operate to prevent a user accident.

Additional embodiments of the present general inventive concept will be set forth in part in the description which follows and, in part, will be obvious from the description, or may be learned by practice of the general inventive concept.

Example embodiments of the present general inventive concept provide a sheet processing device including a body in which a processing unit to process a sheet of paper can be received, a door provided at the body to be opened from or closed to the body, a sensing unit to sense the presence of the sheet of paper fed into the body, and a safety unit linked with the door and adapted to restrict the sensing unit or release the restricted sensing unit.

The sensing unit may include a movably provided first actuator, and the safety unit may include a movably provided second actuator to restrict the first actuator or release the restricted first actuator and an elastic member to bias the second actuator.

The elastic member may bias the second actuator to limit movement of the first actuator.

The door may bias the second actuator to enable movement of the first actuator when the door is closed.

The first actuator may include a first pivoting shaft and a first operating arm extending from the first pivoting shaft to a position where the first operating arm interferes with the sheet of paper.

The second actuator may include a second pivoting shaft, a second operating arm extending from the second pivoting shaft to a position where the second operating arm interferes with the door, and a second braking arm extending from the second pivoting shaft to a position where the second braking arm interferes with the first actuator.

The elastic member may elastically support the second operating arm and may move the second braking arm to a position where the second braking arm limits movement of the first actuator.

The door may press the second operating arm when the door is closed, to move the second braking arm to a position where the second braking arm does not limit movement of the first actuator.

The door may include a press member to press the second operating arm.

The processing unit may perform a punching process or a stapling process.

Example embodiments of the present general inventive concept can also provide an image forming apparatus including a sheet processing device including a body, a door provided at the body to be opened from or closed to the body, a sensing unit to interfere with a sheet of paper introduced into the body so as to be moved along with the sheet of paper, and a safety unit linked with the door and adapted to be moved to a first position where the safety unit limits movement of the sensing unit and a second position where the safety unit enables movement of the sensing unit.

The safety unit may include an actuator to be movable to the first position or the second position, and an elastic member to move the actuator to the second position.

The door may include a press member to move the actuator to the first position.

Example embodiments of the present general inventive concept can also provide a safety unit of a sheet processing device, including an actuator having a first position to prevent operation of the sheet processing device when a user opens a door of the sheet processing device and a second position to enable operation of the sheet processing device when the user closes the door of the sheet processing device.

The actuator can rotate between the first and second positions upon opening and closing of the door, respectively.

The actuator can be rotated into a moving path of an operating arm of the sheet processing device to prevent the operating arm from actuating a power switch of the sheet processing device when the door is open.

Example embodiments of the present general inventive concept can also provide a method of operating a sheet processing unit of an image forming device, the method including opening a door of the sheet processing unit to access an interior of the sheet processing device, and moving an actuator element into a moving path of an operating arm of the sheet processing device to prevent the operating arm from actuating a power switch of the sheet processing device when the door is open.

The actuator element can move out of the moving path of the operating arm to enable the operating arm to actuate the power switch when the door is closed.

BRIEF DESCRIPTION OF THE DRAWINGS

These and/or other embodiments of the present general inventive concept will become apparent and more readily appreciated from the following description of the embodiments, taken in conjunction with the accompanying drawings of which.

DETAILED DESCRIPTION OF THE EMBODIMENTS

Figure 1:
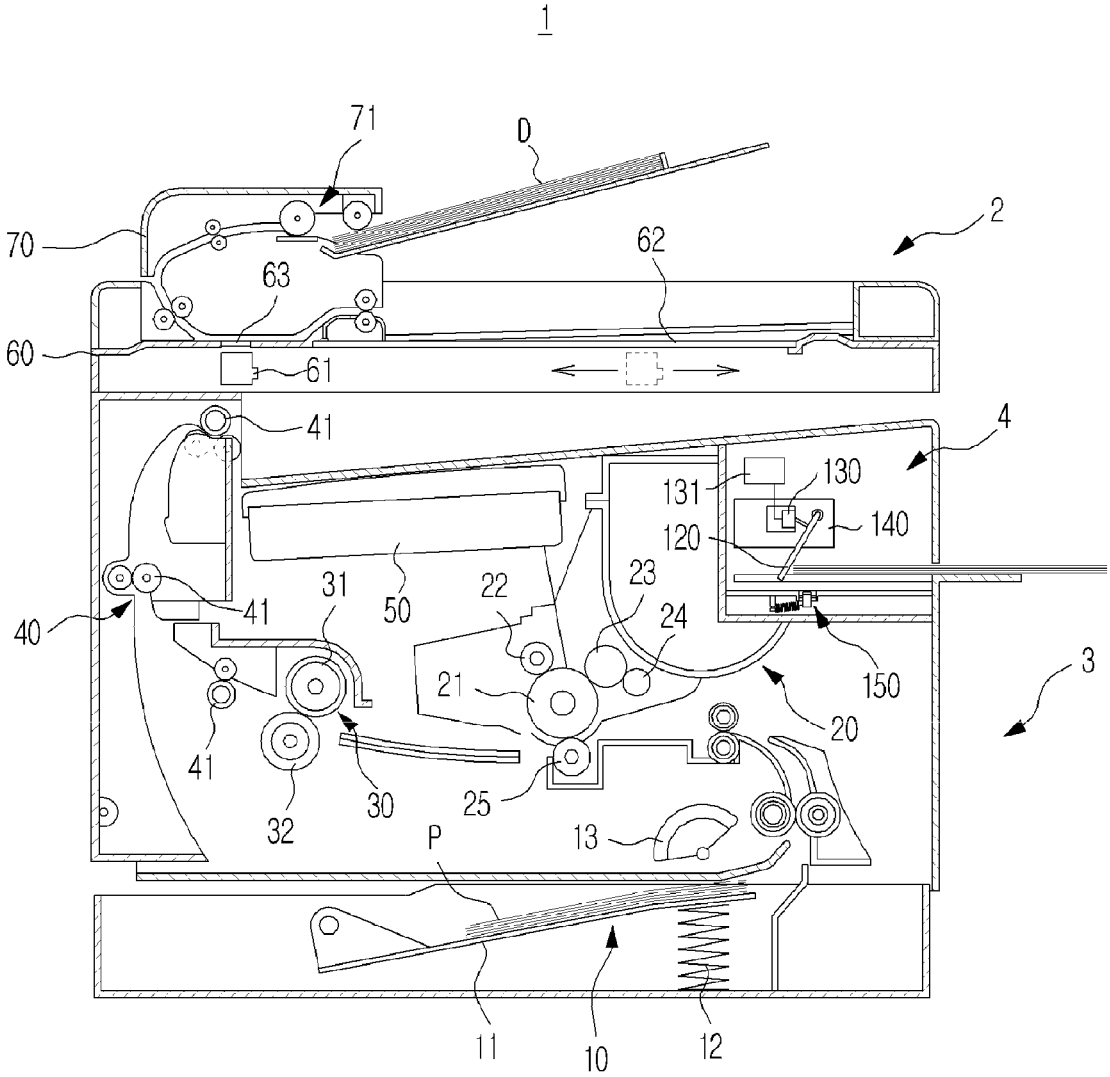
FIG. 1 is a view illustrating a configuration of a multifunctional apparatus including a sheet processing device according to an embodiment of the present general inventive concept.

Reference will now be made in detail to the embodiments of the present general inventive concept, examples of which are illustrated in the accompanying drawings, wherein like reference numerals refer to the like elements throughout.

FIG. 1 is a view illustrating a configuration of a multifunctional apparatus including a sheet processing device according to an embodiment of the present general inventive concept.

As illustrated in FIG. 1, the exemplary multifunctional apparatus 1 can include an image reading device 2 to read an image from a document, a printing device 3 to print the image on a sheet of paper, and a sheet processing device 4 to perform punching or stapling of the sheet of paper. The sheet processing device 4 may be arranged inside or outside of the multifunctional apparatus 1.

The printing device 3 can print an image based on signals input from the image reading device 2 or from signals input from an external appliance, such as a PC, etc. The printing device 3 can include a paper supply unit 10 to supply paper P as printing media, a developing unit 20 to develop an image on paper, a fusing unit 30 to fix the image to paper by applying heat and pressure to the paper, and a paper discharge unit 40 to discharge paper, on which the image can be printed, to the outside of the printing device 3.

The paper supply unit 10 can include a paper tray 11 on which the paper P can be loaded, and a spring 12 to elastically support the paper tray 11. The paper P stacked on the paper tray 11 can be picked up sheet by sheet by a paper pickup roller 13, and can be delivered to the developing unit 20.

The developing unit 20 can include a photosensitive drum 21, an exposure unit 50 to form an electrostatic latent image on a surface of the photosensitive drum 21, a charging roller 22 to charge the photosensitive drum 21, a developing roller 23 to feed toner to the electrostatic latent image formed on the photosensitive drum 21, a feeding roller 24 to feed the toner to the developing roller 23, and a transfer roller 25 to press the paper toward the photosensitive drum 21 in order to transfer a toner image formed on the photosensitive drum 21 to the paper.

The fusing unit 30 can include a heating roller 31 having a heater and a press roller 32 arranged opposite the heating roller 31 and adapted to keep a predetermined fusing pressure between the press roller 32 and the heating roller 31.

The paper discharge unit 40 can include a series of paper discharge rollers 41 successively arranged to discharge the paper to the outside after the paper has passed through the fusing unit 30.

The image reading device 2 can include a scanning frame 60 and a cover 70. The cover 70 can be pivotally rotatably coupled to the scanning frame 60 and can be adapted to open or close an upper surface of the scanning frame 60. An Automatic Document Feeder (ADF) 71 can be provided at the cover 70 and can be adapted to automatically feed documents to enable successive scanning of the documents.

A reading unit 61 can be arranged inside the scanning frame 60. Also, a flat panel glass 62 and ADF glass 63 can be provided at an upper surface of the scanning frame 60.

The reading unit 61 can read image information recorded in a document D by irradiating light to the document D. The reading unit 61 may read the document placed on the flat panel glass 62 while moving under the flat panel glass 62 in a longitudinal direction of the flat panel glass 62. Also, the reading unit 61 may read image information recorded in the document delivered by the automatic document feeder 71 when located under the ADF glass 63.

A sheet of paper, discharged from the printing device 3, can be fed to the sheet processing device 4. The sheet processing device 4 can perform a punching process or a stapling process on the sheet of paper. The sheet processing device 4, as illustrated in FIG. 1, may be provided in a side region of the multifunctional apparatus 1. Although not illustrated, a sheet of paper returned from the printing device 3 may be automatically fed to the sheet processing device 4.

Figure 2:
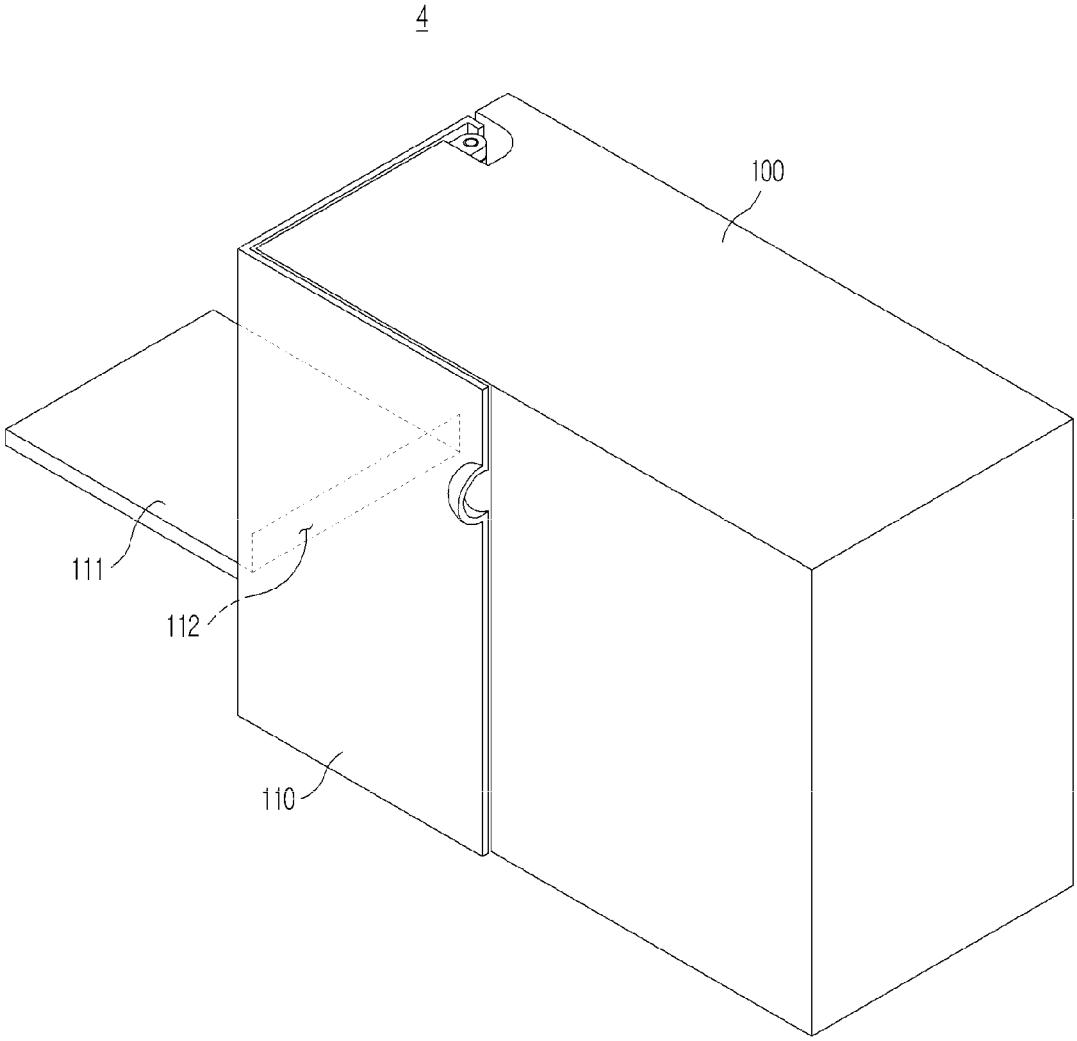
FIG. 2 is a perspective view illustrating a closed state of door of the sheet processing device according to an embodiment of the present general inventive concept.
Figure 3:
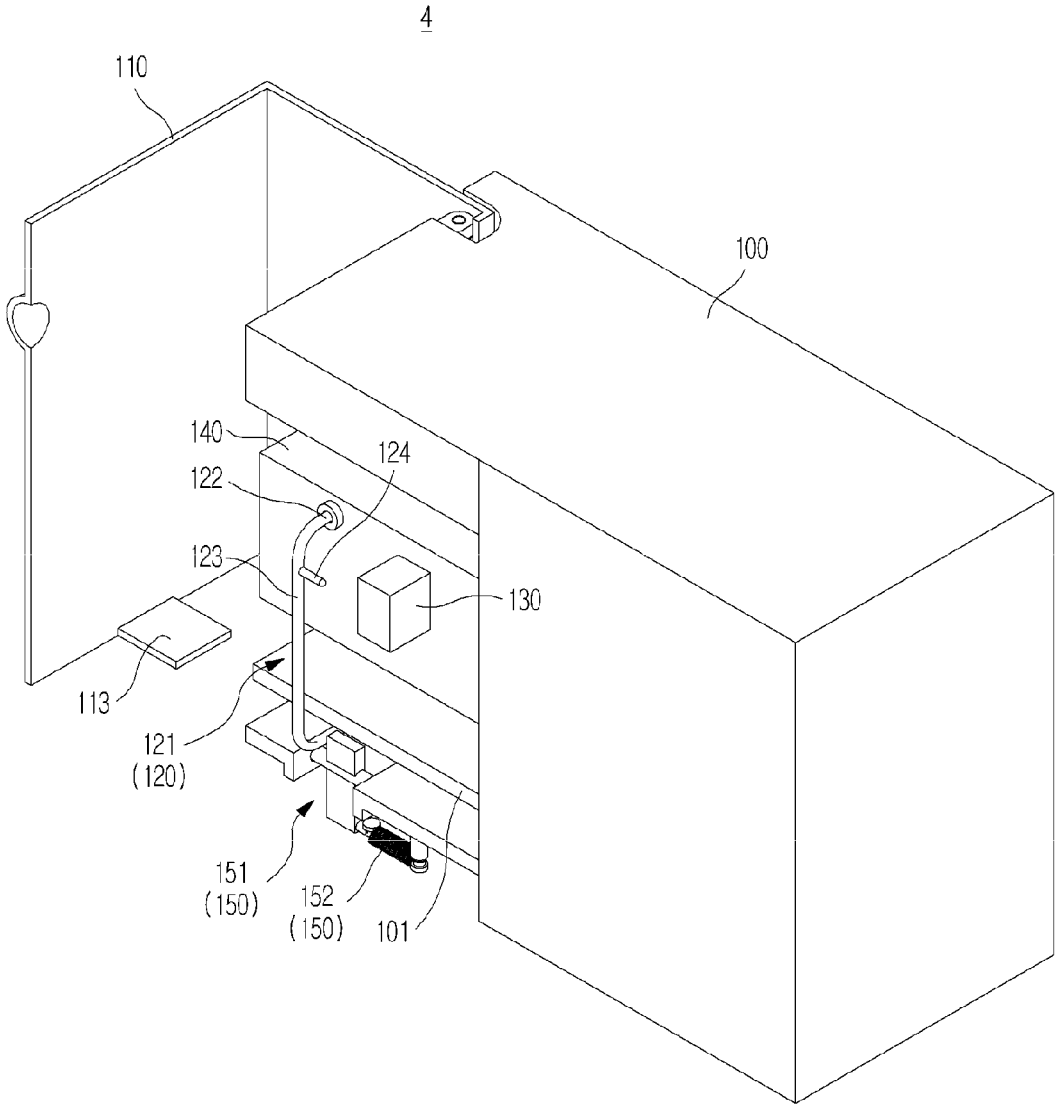
FIG. 3 is a perspective view illustrating an opened state of the door of the sheet processing device according to an embodiment of the present general inventive concept.

FIG. 2 is a perspective view illustrating a closed state of a door of the sheet processing device according to an embodiment of the present general inventive concept, and FIG. 3 is a perspective view illustrating an opened state of the door of the sheet processing device of FIG. 2.

As illustrated in FIGS. 1 to 3, the sheet processing device 4 can include a body 100, and a door 110 pivotally coupled to the body 100. In an opened state of the door as illustrated in FIG. 3, a user can access the interior of the body 100, for example, to clean the interior of the body 100 or to replace consumable elements inside the body 100.

As illustrated in FIG. 2, the door 110 can include a sheet receiver 111 and a sheet insertion hole 112. A sheet of paper can be fed into the body 100 through the sheet insertion hole 112 while being partially supported on the sheet receiver 111. A press member 113 can be formed at an inner surface of the door 110 and can be adapted to press a safety unit 150, as illustrated in FIG. 3 and as described in more detail below.

Referring to FIGS. 2 and 3, the body 100 can contain a sheet tray 101, such that the sheet of paper inserted into the body 100 through the sheet insertion hole 112 can be stacked on the sheet tray 101. In this case, a width of the sheet tray 101 may be smaller than a sheet width, in order to allow a sensing unit 120 provided around the sheet tray 101 to sense the presence of the sheet of paper.

The body 100 can contain the sensing unit 120 to sense the presence of the sheet of paper, and a processing unit 140 to perform a punching process or a stapling process on the sheet of paper stacked on the sheet tray 101.

The sensing unit 120 can sense whether or not the sheet of paper is inserted into the body 100. The sensing unit 120 can include a first actuator 121 to interfere with the sheet of paper when the sheet of paper is inserted. The first actuator 121 can include a first pivoting shaft 122, a first operating arm 123 extending from the first pivoting shaft 122 to a position where the first operating arm 123 interferes with the sheet of paper, and a first connecting arm 124 extending from the first operating arm 123 to a position where the first connecting arm 124 is connected to a micro-switch 130 to turn on the micro-switch 130.

The first operating arm 123 can be located at the outside of either side edge of the sheet tray 101. The sheet tray 101 can have a width smaller than a sheet width and the first operating arm 123 can be positioned to interfere with the sheet of paper. Also, the first operating arm 123 can be pivotable about the first pivoting shaft 122. Accordingly, when the sheet of paper presses the first operating arm 123, the first operating arm 123 can be pivoted in a sheet advance direction.

The first connecting arm 124 can be connected to the micro-switch 130 to turn on the micro-switch 130, so as to supply power to the processing unit 140. When the first operating arm 123 is pivoted into the paper advance direction, the first connecting arm 124 can move into the paper advance direction to thereby connect the micro-switch 130.

The micro-switch 130 can connect or release the processing unit 140 to or from a power supply source 131. For example, when the first connecting arm 124 is connected to the micro-switch 130 to turn on the micro-switch 130, the power supply source 131 can supply power to the processing unit 140 to operate the processing unit 140. On the other hand, when the first connecting arm 124 is separated from the micro-switch 130 to turn off the micro-switch 130, supply of power to the processing unit 140 can be intercepted and therefore, operation of the processing unit 140 may be prevented.

The processing unit 140 can perform a punching process or a stapling process on the sheet of paper stacked on the sheet tray 101. The processing unit 140 can rotate a motor (not illustrated) for a predetermined cycle and can perform a punching process or a stapling process with a rotating force of the motor.

As the sheet of paper is introduced onto the sheet tray 101, the sheet of paper can interfere with the first operating arm 123, causing the first operating arm 123 to be rotated in the paper advance direction. The first connecting arm 124 can be simultaneously rotated together with the first operating arm 123 to connect to the micro-switch 130 and to turn-on the micro-switch 130. If the micro-switch 130 is turned on, power can be supplied from the power supply source 131 to the processing unit 140 and thus, the processing unit 140 can perform a punching process or a stapling process on the sheet of paper.

In the course of removing impurities from the interior of the body 100 or replacing consumable elements inside the body 100 in an opened state of the door 110, it is possible that the user may accidentally rotate the first actuator 121 such that the first connecting arm 124 is connected to the micro-switch 130 to turn on the micro-switch 130, resulting in unwanted supply of power to the processing unit 140. In this case, if contact occurs between the user and the processing unit 140, it may cause a user accident. The present general inventive concept can provide a safety unit 150 to prevent the sensing unit 120 from being connected to the micro-switch 130 in the opened state of the door 110.

Figure 4:
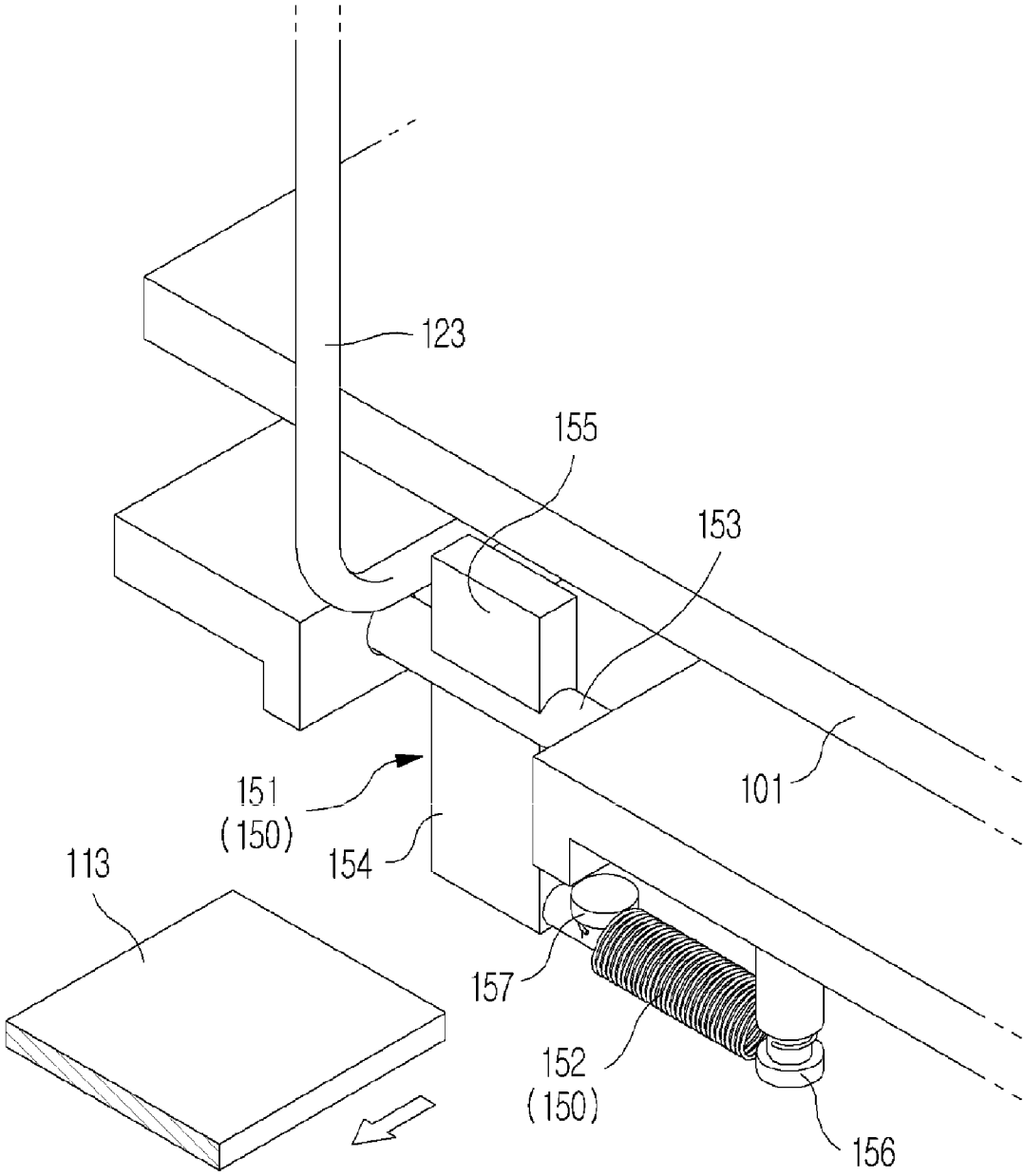
FIG. 4 is a perspective view illustrating a first position of a safety unit according to an embodiment of the present general inventive concept.
Figure 5:
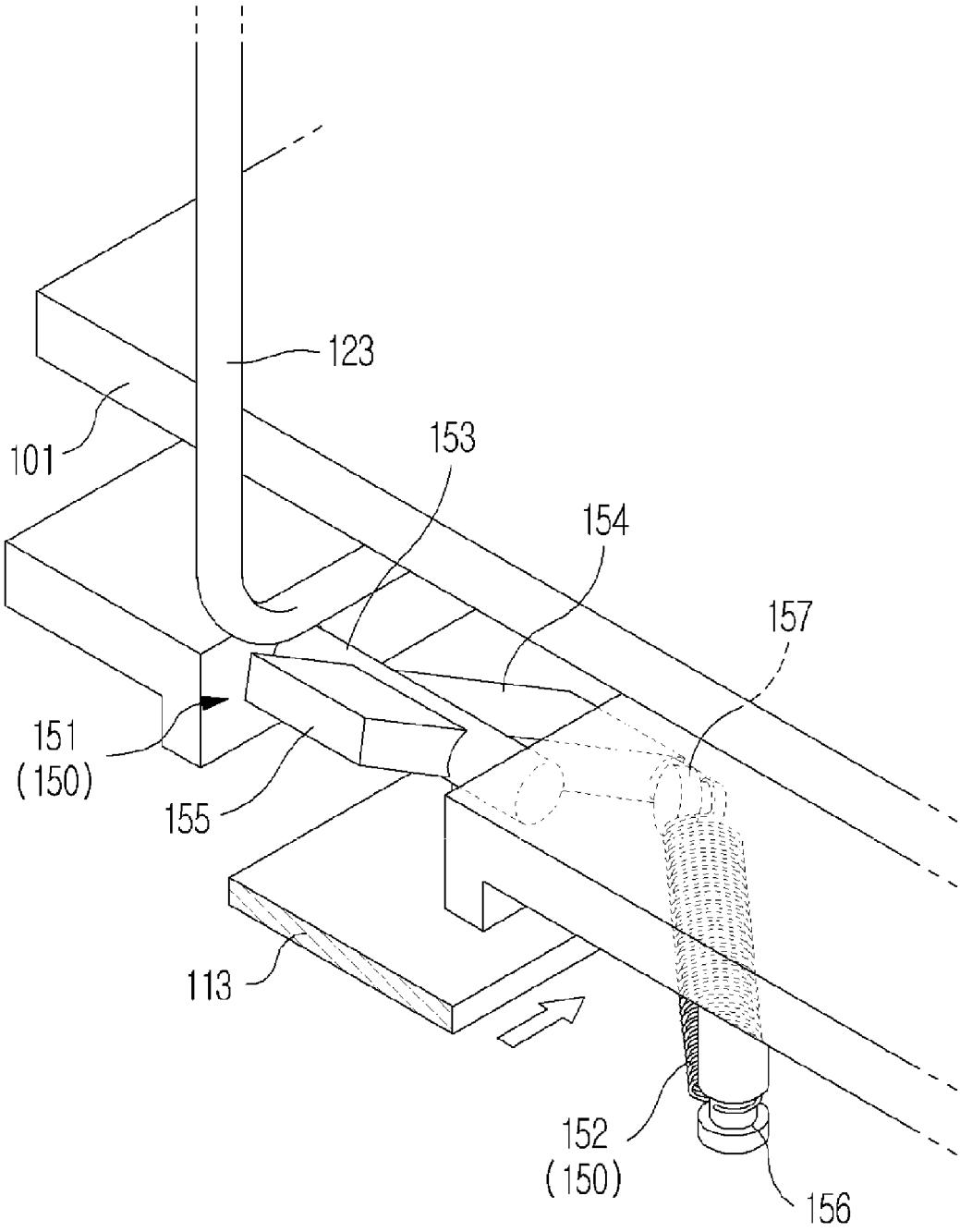
FIG. 5 is a perspective view illustrating a second position of the safety unit according to an embodiment of the present general inventive concept.

FIG. 4 is a perspective view illustrating a first position of the safety unit according to an example embodiment of the present general inventive concept, and FIG. 5 is a perspective view illustrating a second position of the safety unit according to the example embodiment of FIG. 4.

FIG. 4 illustrates a state wherein the safety unit 150 can limit movement of the first operating arm 123 in an opened state of the door 110, and FIG. 5 illustrates a state wherein the safety unit 150 does not limit movement of the first operating arm 123 in a closed state of the door 110.

As illustrated in FIGS. 4 and 5, the safety unit 150 can include a second actuator 151 linked with the door 110, and an elastic member 152 to elastically support the second actuator 151 in a given direction.

The second actuator 151 can be linked with the door 110 to restrict or enable movement of the first operating arm 123. Here, a position of the second actuator 151 where the second actuator 151 restricts the first operating arm 123 to limit movement of the first operating arm 123 can be referred to as a first position (see FIG. 4). Also, a position of the second actuator 151 where the second actuator 151 releases the restricted first operating arm 123 to enable movement of the first operating arm 123 can be referred to as a second position (see FIG. 5).

The second actuator 151 can include a second pivoting shaft 153 rotatably coupled to the body 100, a second operating arm 154 extending from the second pivoting shaft 153 to a position where the second operating arm 154 can interfere with the press member 113, and a second braking arm 155 extending from the second pivoting shaft 153 to a position where the second braking arm 155 can interfere with the first operating arm 123. In the first position, the second braking arm 155 can be moved so as to interfere with the first operating arm 123. Also, in the second position, the second braking arm 155 can be moved so as not to interfere with the first operating arm 123.

The elastic member 152 can elastically support the second actuator 151, to allow the second actuator 151 to be moved to the first position to restrict the first operating arm 123. The elastic member 152 may be, for example, a spring having one end fixed to a first holder 156 of the body 100 and the other end fixed to a second holder 157 of the second operating arm 154. Accordingly, as the second operating arm 154 is rotated by elastic force of the elastic member 152, the second braking arm 155 can be moved to the first position to restrict the first operating arm 123. As a result, it is possible that the elastic force of the elastic member 152 can act on the second actuator 151 when the door 110 is opened such that the second actuator 151 can limit movement of the first operating arm 123 in the first position.

On the contrary, the press member 113 can be configured to press the second operating arm 154 when the door 110 is closed to rotate the second operating arm 154. When the second operating arm 154 is rotated, the second braking arm 155 can be moved to the second position to release the restriction of the first operating arm 123.

Thus, when the door 110 is opened as illustrated in FIG. 4, the second actuator 151 can be moved to the first position by the elastic force of the elastic member 152, thereby restricting the first operating arm 123 and limiting movement of the first operating arm 123. On the contrary, when the door 110 is closed, the second actuator 151 can be moved to the second position by the press force of the press member 113, thereby releasing the restriction of the first operating arm 123 and allowing movement of the first operating arm 123.

A method of operating a sheet processing device 4 according to an example embodiment of the present general inventive concept will be described with reference to FIGS. 1 to 5.

Referring to FIGS. 1 to 5, the printing device 3 can discharge a printing medium to which an image has been transferred. The printing medium, e.g., a sheet of paper having passed through the printing device 3, can be fed to the sheet processing device 4 for a punching process or a stapling process thereof.

The sheet of paper can pass through the sheet insertion hole 112 of the closed door 110, thereby being stacked on the sheet tray 101. When the sheet of paper is stacked on the sheet tray 101, the sheet of paper can act to push the first operating arm 123. In this case, the second actuator 151 can be moved to the second position (FIG. 5) by the press member 113 and thus, does not limit movement of the first operating arm 123. Thus, the first operating arm 123 can be moved in the paper advance direction, and simultaneously, the first connecting arm 124 can be moved to be connected to the micro-switch 130 so as to turn-on the micro-switch 130 to supply power to the processing unit 140. In this way, the processing unit 140 may perform a punching process or a stapling process of the sheet of paper stacked on the sheet tray 101.

However, to remove impurities or replace consumable elements inside the sheet processing device 4, the user may open the door 110. In an opened state of the door 110 as illustrated in FIG. 4, the second actuator 151 can be moved to the first position by the elastic member 152, thereby limiting movement of the first operating arm 123. Accordingly, even if the first operating arm 123 is pushed by the introduced sheet of paper or the user accidentally operates the first operating arm 123, movement of the first operating arm 123 can be limited by the second braking arm 155. In this case, the micro-switch 130 can intercept power supplied to the processing unit 140 and therefore, operation of the processing unit 140 may be prevented.

As is apparent from the above description, in a sheet processing device according to example embodiments of the present general inventive concept, when a user opens a door of the sheet processing device and performs an operation to remove impurities or replace consumable elements inside the sheet processing device, no danger is present and user accidents may be prevented.

Although a few example embodiments of the present general inventive concept have been illustrated and described, it will be appreciated by those skilled in the art that changes may be made in these example embodiments without departing from the principles and spirit of the general inventive concept, the scope of which is defined in the claims and their equivalents.

What is claimed is:

1. A sheet processing device comprising:

a body to receive a processing unit to process a sheet of paper;

a door provided at the body to be opened from or closed to the body;

a sensing unit to sense the presence of the sheet of paper fed into the body; and a safety unit linked with the door to restrict the sensing unit or release the restricted sensing unit.

wherein the sensing unit includes a movably provided first actuator, and wherein the safety unit includes a movably provided second actuator to restrict the first actuator or release the restricted first actuator.

2. The device according to claim 1, wherein the sensing unit includes an elastic member to bias the second actuator.

3. The device according to claim 2, wherein the elastic member biases the second actuator to limit movement of the first actuator.

4. The device according to claim 3, wherein the door biases the second actuator to enable movement of the first actuator when the door is closed.

5. The device according to claim 2, wherein the first actuator includes a first pivoting shaft and a first operating arm extending from the first pivoting shaft to a position where the first operating arm interferes with the sheet of paper.

6. The device according to claim 2, wherein the second actuator includes a second pivoting shaft, a second operating arm extending from the second pivoting shaft to a position where the second operating arm interferes with the door, and a second braking arm extending from the second pivoting shaft to a position where the second braking arm interferes with the first actuator.

7. The device according to claim 6, wherein the elastic member elastically supports the second operating arm and moves the second braking arm to a position where the second braking arm limits movement of the first actuator.

8. The device according to claim 7, wherein the door presses the second operating arm when the door is closed to move the second braking arm to a position where the second braking arm does not limit movement the first actuator.

9. The device according to claim 8, wherein the door includes a press member to press the second operating arm.

10. The device according to claim 1, wherein the processing unit performs a punching process or a stapling process.

11. An image forming apparatus having a sheet processing device, wherein the sheet processing device comprises:

a body;

a door provided at the body to be opened from or closed to the body;

a sensing unit to interfere with a sheet of paper introduced into the body so as to be moved along with the sheet of paper; and a safety unit linked with the door and having a first position where the safety unit limits movement of the sensing unit and a second position where the safety unit enables movement of the sensing unit, wherein the safety unit includes an actuator to move the safety unit to the first position or the second position to inhibit operation of the sensing unit.

12. The apparatus according to claim 11, wherein the safety unit includes an elastic member to move the actuator to the second position.

13. The apparatus according to claim 12, wherein the door includes a press member to move the actuator to the first position.

14. A safety unit of a sheet processing device, comprising:

an actuator movable between a first position to prevent operation of a sensing unit of the sheet processing device when a user opens a door of the sheet processing device and a second position to enable operation of the sensing unit when the user closes the door of the sheet processing device.

15. The safety unit of claim 14, wherein the actuator rotates between the first and second positions upon opening and closing of the door, respectively.

16. The safety unit of claim 14, wherein the actuator is rotated into a moving path of an operating arm of the sheet processing device to prevent the operating arm from actuating a power switch of the sheet processing device when the door is open.

17. A method of operating a sheet processing device of an image forming device, the method comprising:

opening a door of the sheet processing device to access an interior of the sheet processing device; and moving an actuator element into a moving path of an operating arm of the sheet processing device to prevent the operating arm from actuating a power switch of the sheet processing device when the door is open.

18. The method of claim 17, wherein the actuator element moves out of the moving path of the operating arm to enable the operating arm to actuate the power switch when the door is closed.

* * * * *